US008911059B2

(12) United States Patent
Tamaki

(10) Patent No.: US 8,911,059 B2
(45) Date of Patent: Dec. 16, 2014

(54) LIQUID EJECTION DEVICE, METHOD, AND NON-TRANSITORY, COMPUTER-READABLE STORAGE MEDIUM FOR LIQUID EJECTION DEVICE

(71) Applicant: Shuichi Tamaki, Nagoya (JP)

(72) Inventor: Shuichi Tamaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/142,680

(22) Filed: Dec. 27, 2013

(65) Prior Publication Data

US 2014/0184675 A1 Jul. 3, 2014

(30) Foreign Application Priority Data

Dec. 28, 2012 (JP) ..... 2012-288820

(51) Int. Cl.
*B41J 2/155* (2006.01)

(52) U.S. Cl.
USPC ..... 347/42; 347/9; 347/35

(58) Field of Classification Search
USPC ..... 347/5, 9, 13, 14, 35, 42
See application file for complete search history.

(56) References Cited

U.S. PATENT DOCUMENTS

| | | | | |
|---|---|---|---|---|
| 7,513,599 | B2 * | 4/2009 | Wada et al. | 347/42 |
| 2002/0085052 | A1 * | 7/2002 | Danzuka | 347/9 |
| 2005/0275684 | A1 * | 12/2005 | Yamaguchi et al. | 347/42 |
| 2009/0225129 | A1 * | 9/2009 | Fukushi | 347/35 |
| 2012/0194603 | A1 | 8/2012 | Takeda et al. | |

FOREIGN PATENT DOCUMENTS

| | | | |
|---|---|---|---|
| JP | H10-181040 | A | 7/1998 |
| JP | H11-091140 | A | 4/1999 |
| JP | 2012-158421 | A | 8/2012 |

* cited by examiner

*Primary Examiner* — Lam S Nguyen
(74) *Attorney, Agent, or Firm* — Baker Botts L.L.P.

(57) ABSTRACT

A liquid ejection device may include a liquid ejection head, a conveyor mechanism, a liquid discharging device, and a control device. The control device may be configured to determine a dimension of a recording medium, and determine one or more first ejection nozzles of the liquid discharging device, which correspond to an edge of the recording medium, based on the dimension. The control device may be further configured to control the liquid discharging device to perform a liquid discharging process after the liquid ejection head records an image onto the recording medium, wherein in the liquid discharging process, an amount of liquid discharged from each of the one or more first ejection nozzles is larger than an amount of liquid discharged from each of one or more second ejection nozzles, which correspond to a more inward area of the recording medium than an area corresponding to the one or more first ejection nozzles.

14 Claims, 12 Drawing Sheets

LIQUID EJECTION DEVICE, METHOD, AND NON-TRANSITORY, COMPUTER-READABLE STORAGE MEDIUM FOR LIQUID EJECTION DEVICE

CROSS-REFERENCE TO RELATED APPLICATION

This application claims priority from Japanese Patent Application No. 2012-288820, filed on Dec. 28, 2012, which is incorporated herein by reference.

FIELD OF DISCLOSURE

Aspects described herein generally relate to a liquid ejection device including a liquid ejection head including an ejection surface having a plurality of ejection nozzles therein, a method of discharging liquid from the liquid ejection device, and a non-transitory computer-readable storage medium for the liquid ejection device.

BACKGROUND

A known liquid ejection device includes a line-type head including an ejection surface having a plurality of ejection nozzles therein, a conveyor mechanism configured to convey a recording medium to a printing area facing the ejection surface, and a liquid discharging device. When a recording medium is conveyed to the printing area by the conveyor mechanism, liquid is ejected onto the recording medium from the plurality of ejection nozzles, such that an image is recorded on a surface of the recording medium.

SUMMARY

A relatively large amount of foreign matter (e.g., paper dust or the like) is adhered to a certain area of the ejection surface. The certain area may be areas of the ejection surface that correspond to respective edges of the recording medium in a direction orthogonal to a conveyance direction of the recording medium conveyed by the conveyor mechanism. A relatively large amount of foreign matter (e.g., paper dust or the like) may be adhered to edges of each of the recording media because when recording media is produced by cutting in a recording media manufacturing process, foreign matter may be adhered to the ejection surface from edges of a recording medium when the recording medium being conveyed by the conveyor mechanism passes near the ejection surface during printing. At the time of maintenance of the liquid ejection device, a liquid discharging process may be performed simultaneously on all of the plurality of ejection nozzles in the ejection surface by a liquid discharging device. Therefore, an amount of liquid discharged from the plurality of ejection nozzles may need to be set suitable for one or more ejection nozzles that may be required to discharge a largest amount of liquid to remove foreign matter therefrom, i.e., one or more ejection nozzles corresponding to the edges of the recording medium. Thus, the rest of the plurality of ejection nozzles may discharge more liquid than necessary.

Accordingly, embodiments of the present invention provide for a liquid ejection device, a method, and a computer-readable storage medium storing a control program for the liquid ejection device that reduces an amount of liquid discharged at the time of maintenance.

Embodiments described herein provide for a liquid ejection device that may include a liquid ejection head, a conveyor mechanism, a liquid discharging device, and a control device.

The liquid ejection head may include an ejection surface having a plurality of ejection nozzles for ejecting liquid to record an image. The conveyor mechanism may be configured to convey a recording medium in a predetermined first direction. The liquid discharging device may be configured to discharge liquid from at least one of the plurality of ejection nozzles. The control device may be configured to control the liquid ejection head, the conveyor mechanism, and the liquid discharging device. The control device may be further configured to determine a dimension in a second direction of the recording medium conveyed by the conveyor mechanism. The second direction may be orthogonal to the first direction. The control device may be further configured to determine one or more first ejection nozzles that are one or more ejection nozzles, which correspond to an edge of the recording medium in the second direction, of the plurality of ejection nozzles, wherein the dimension in the second direction of the recording medium has been determined. The control device may be further configured to control the liquid discharging device to perform a liquid discharging process after the liquid ejection head records an image onto the recording medium, the dimension in the second direction of which has been determined, wherein in the liquid discharging process, an amount of liquid discharged from each of the one or more first ejection nozzles is greater than an amount of liquid discharged from each of one or more second ejection nozzles that are one or more ejection nozzles, which correspond to a more inward area of the recording medium than an area corresponding to the one or more first ejection nozzles, of the plurality of ejection nozzles.

In an embodiment of the invention, a non-transitory, computer-readable storage medium storing computer-readable instructions therein that, when executed by at least one processor of a liquid ejection device comprising a liquid ejection head comprising an ejection surface comprising a plurality of ejection nozzles configured to eject liquid to record an image, a conveyor mechanism configured to convey a recording medium in a first direction, and a liquid discharging device configured to discharge the liquid from at least one of the plurality of ejection nozzles, instruct the liquid ejection device to execute processes. The processes comprise determining a dimension in a second direction of the recording medium conveyed by the conveyor mechanism, wherein the second direction is orthogonal to the first direction; and controlling the liquid discharging device to discharge the liquid according to a liquid discharging process after the liquid ejection head records an image onto the recording medium, the dimension in the second direction of which has been determined, wherein in the liquid discharging process, an amount of liquid discharged from each of one or more first ejection nozzles, which is one or more ejection nozzles, of the plurality of ejection nozzles, that correspond to an edge portion of the recording medium based on the dimension in the second direction, is greater than an amount of liquid discharged from each of one or more second ejection nozzles, which is one or more ejection nozzles, of the plurality of ejection nozzles, that correspond to an inward area of the recording medium, the inward area of the recording medium being an area of the recording medium that is between a first edge and a second edge of the recording medium in the second direction and excluding the edge portion of the recording medium.

In an embodiment of the invention, a method of discharging liquid from a liquid ejection device comprising a liquid ejection head comprising an ejection surface comprising a plurality of ejection nozzles configured to eject liquid to record an image, a conveyor mechanism configured to convey a recording medium in a first direction, and a liquid discharging device configured to discharge the liquid from at least one of the plurality of ejection nozzles, is provided. The method comprises: determining a dimension in a second direction of the recording medium conveyed by the conveyor mechanism, wherein the second direction is orthogonal to the first direction; and controlling the liquid discharging device to discharge the liquid according to a liquid discharging process after the liquid ejection head records an image onto the recording medium, the dimension in the second direction of which has been determined, wherein in the liquid discharging process, an amount of liquid discharged from each of one or more first ejection nozzles, which is one or more ejection nozzles, of the plurality of ejection nozzles, that correspond to an edge portion of the recording medium based on the dimension in the second direction, is greater than an amount of liquid discharged from each of one or more second ejection nozzles, which is one or more ejection nozzles, of the plurality of ejection nozzles, that correspond to an inward area of the recording medium, the inward area of the recording medium being an area of the recording medium that is between a first edge and a second edge of the recording medium in the second direction and excluding the edge portion of the recording medium.

According to the aspects of the disclosure, paper dust may be likely to adhere to the one or more first ejection nozzles that may be one or more ejection nozzles corresponding to the edge of the recording medium in the second direction. Therefore, it may be preferable that the amount of liquid discharged from the one or more first ejection nozzles is increased to remove paper dust therefrom more easily. With the above-described configuration, the liquid discharging process in which the amount of liquid discharged from each of the one or more first ejection nozzles may be larger than the amount of liquid discharged from each of the one or more second ejection nozzles may be performed. Accordingly, the amount of liquid discharged from each of the one or more first ejection nozzles may be increased while the amount of liquid discharged from the plurality of ejection nozzles may be decreased. Therefore, according to aspects of the invention, the above-described configuration may reduce an amount of liquid discharged at the time of maintenance, and thus, may reduce maintenance costs.

BRIEF DESCRIPTION OF THE DRAWINGS

For a more complete understanding of embodiments of the present invention, needs satisfied thereby, and the objects, features, and advantages thereof, reference now is made to the following descriptions taken in connection with the accompanying drawings.

DETAILED DESCRIPTION

Hereinafter, illustrative embodiments of a liquid ejection device according to the aspects of the disclosure are described with reference to the accompanying drawings. In the illustrative embodiments, the "liquid ejection device" may be applied to an inkjet printer, and an ink ejection head may be used as a "liquid ejection head" and a sheet may be used as a "recording medium".

Figure 1:
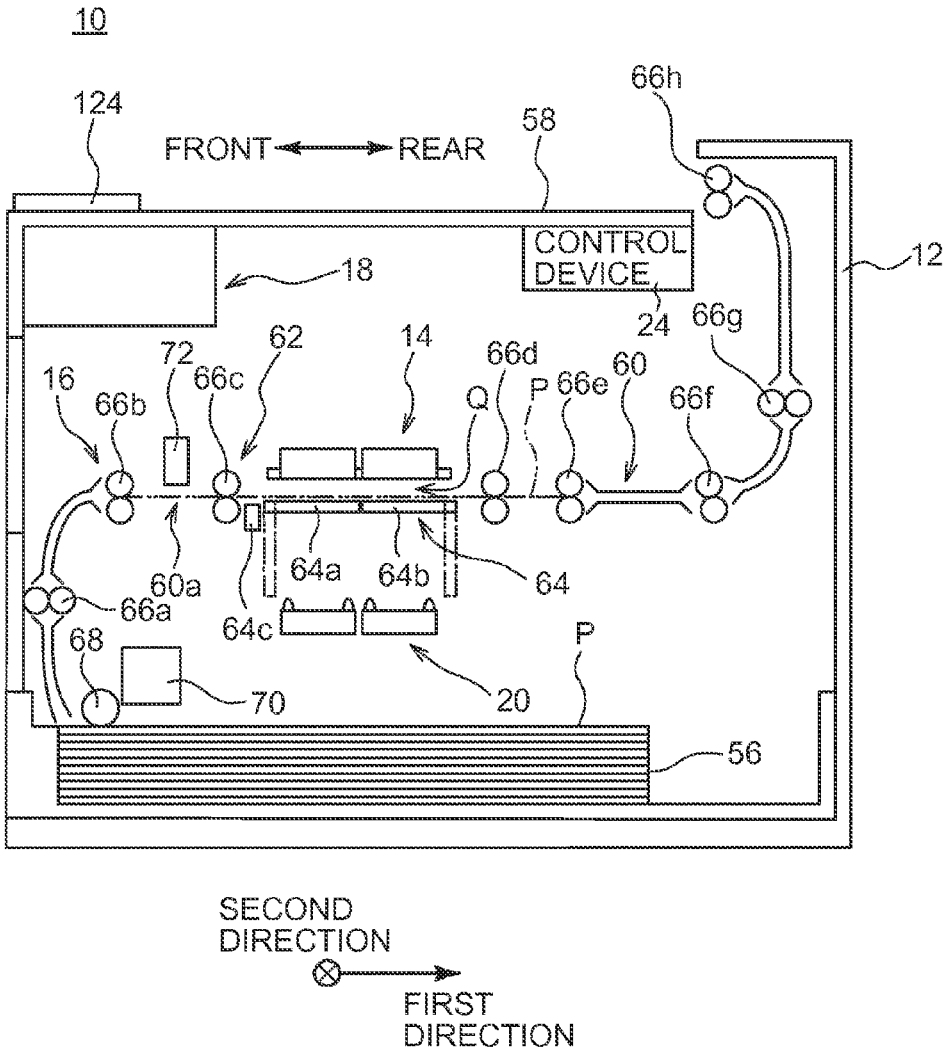
FIG. 1 depicts a configuration of an inkjet printer in an illustrative embodiment, according to one or more aspects of the disclosure.

As depicted in FIG. 1, an inkjet printer 10 may comprise a housing 12, an ink ejection head 14, a conveyor mechanism 16, an ink supply mechanism 18, and a purge mechanism 20. The ink ejection head 14 may be configured to eject ink onto a sheet P in a predetermined recording area Q to record an image on the sheet P. The conveyor mechanism 16 may be configured to convey a sheet P to the recording area Q. The ink supply mechanism 18 may be configured to supply ink to the ink ejection head 14. The purge mechanism 20 may constitute a "liquid discharging device" configured to force at least one ejection nozzle 40 of a plurality of ejection nozzles 40 (see FIG. 5) to discharge ink (i.e., liquid) therefrom at the time of maintenance. The inkjet printer 10 may further comprise a wiper mechanism 22 (see FIG. 2) and a control device 24 (see FIGS. 1 and 3). The wiper mechanism 22 may be configured to wipe foreign matter (e.g., paper dust, ink, and dust particles) from an ejection surface 42 of the ink ejection head 14 at the time of maintenance. The control device 24 may be configured to perform various control operations.

In the illustrative embodiment, a direction that a sheet P is conveyed with respect to the recording area Q depicted in FIG. 1 may be referred to as a "first direction (i.e., a main scanning direction)", and a direction orthogonal to the first direction in plan view may be referred to as a "second direction (i.e., a sub-scanning direction)". Directions of the front, rear, left, and right may be defined for convenience of description. In FIG. 1, the left side of the housing 12 of the inkjet printer 10 may be defined as the "front" of the inkjet printer 10, and the right side of the housing 12 may be defined as the "rear" of the inkjet printer 10. When viewed from the front of the inkjet printer 10, the right side of the housing 12 may be defined as the "right" of the inkjet printer 10 and the left side of the housing 12 may be defined as the "left" of the inkjet printer 10.

Figure 4:
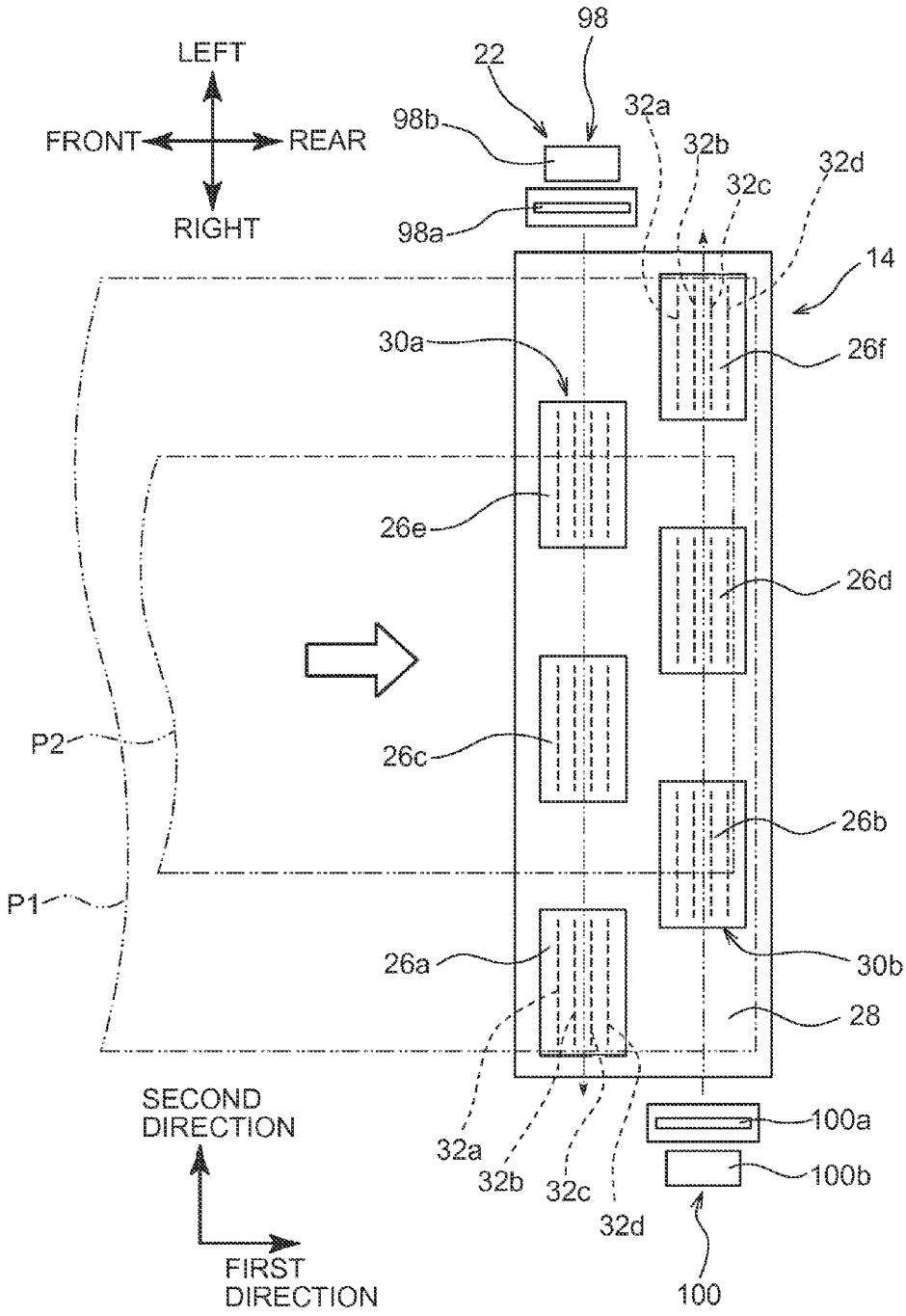
FIG. 4 is a plan view depicting a positional relationship (in a case of center alignment) between each head unit of the ink ejection head and each of sheets having different sizes conveyed by a conveyor mechanism in the illustrative embodiment, according to one or more aspects of the disclosure.

In the illustrative embodiment, as depicted in FIG. 4, "center alignment" may be adopted, wherein a center line of each of sheets P1 and P2 may be aligned with a center line of the ink ejection head 14 in the second direction. Hereinafter, when there is no need to consider the size of sheets P1 and P2, a sheet may be simply referred to as a sheet P without distinction.

As depicted in FIG. 4, the ink ejection head 14 may comprise a plurality of, for example, six, head units 26*a*, 26*b*, 26*c*, 26*d*, 26*e*, and 26*f*, and a head frame 28 configured to support the head units 26*a*, 26*b*, 26*c*, 26*d*, 26*e*, and 26*f*. The first head unit 26*a*, the third head unit 26*c*, and the fifth head unit 26*e* of the head units 26*a*, 26*b*, 26*c*, 26*d*, 26*e*, and 26*f* may be arranged in the second direction at predetermined intervals to constitute a first head row 30*a* that may extend in the second direction. The second head unit 26*b*, the fourth head unit 26*d*, and the sixth head unit 26*f* of the head units 26*a*, 26*b*, 26*c*, 26*d*, 26*e*, and 26*f* may be arranged in the second direction at predetermined intervals behind the first head row 30*a* to constitute a second head row 30*b* that may extend in the second direction.

Figure 2:
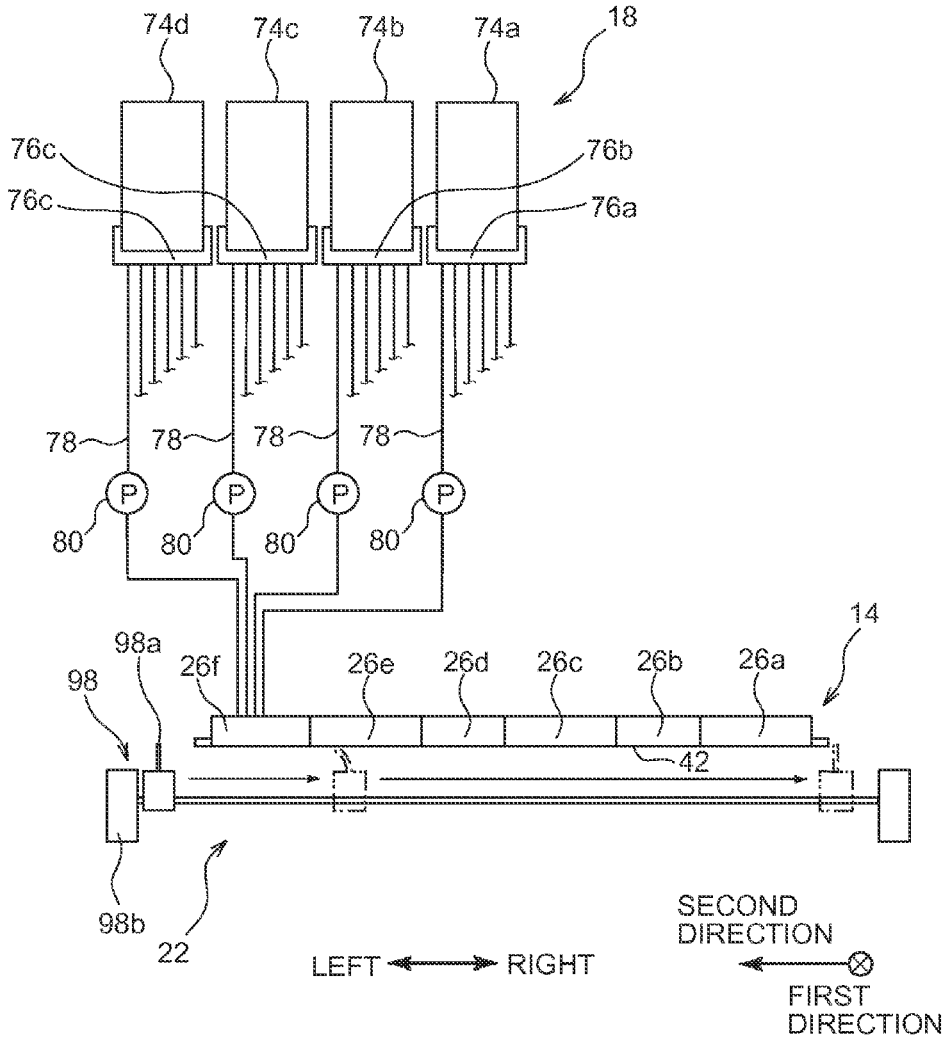
FIG. 2 depicts configurations of an ink ejection head, an ink supply mechanism, and a wiper mechanism in the illustrative embodiment, according to one or more aspects of the disclosure.

As depicted in FIG. 2, when the ink ejection head 14 is viewed from the front (or the rear) of the inkjet printer 10, the second head unit 26*b* may be disposed between the first head unit 26*a* and the third head unit 26*c* in the second direction, and the fourth head unit 26*d* may be disposed between the third head unit 26*c* and the fifth head unit 26*e* in the second direction. Further, the third head unit 26*c* may be disposed between the second head unit 26*b* and the fourth head unit 26*d* in the second direction, and the fifth head unit 26*e* may be disposed between the fourth head unit 26*d* and the sixth head unit 26*f* in the second direction. As depicted in FIG. 4, each of the head units 26*a*, 26*b*, 26*c*, 26*d*, 26*e*, and 26*f* may comprise rows of ejection nozzles 40 (see FIG. 5) (hereinafter, each referred to as an "ejection nozzle row") corresponding to ink (i.e., liquid) of colors of magenta, cyan, yellow, and black, respectively. The ejection nozzle rows 32*a*, 32*b*, 32*c*, and 32*d* may be disposed side by side in the first direction while extending in the second direction. A distance between a right end of each of the ejection nozzle rows 32*a*, 32*b*, 32*c*, and 32*d* in the first head unit 26*a* and a left end of each of the ejection nozzle rows 32*a*, 32*b*, 32*c*, and 32*d* in the sixth head unit 26*f* may be substantially the same or greater than a dimension, in the second direction, of a sheet P1 that may have a maximum dimension in the second direction, among sheets P to be conveyed to the recording area Q (see FIG. 1) (hereinafter, referred to as a second-directional dimension of a sheet P). Therefore, the plurality of head units 26*a*, 26*b*, 26*c*, 26*d*, 26*e*, and 26*f* may be configured to form an image on each of sheets P having different sizes to be conveyed to the recording area Q (FIG. 1). As depicted in FIG. 4, when an image is formed onto a sheet P2 having a minimum dimension in the second direction among the sheets P to be conveyed to the recording area Q (see FIG. 1), at least head units that might not correspond to the sheet P2 (i.e., head units that might not face the sheet P2), e.g., the first head unit 26*a* and the sixth head unit 26*f*, might not perform an operation of recording an image (hereinafter, referred to as a "printing operation").

Figure 5:
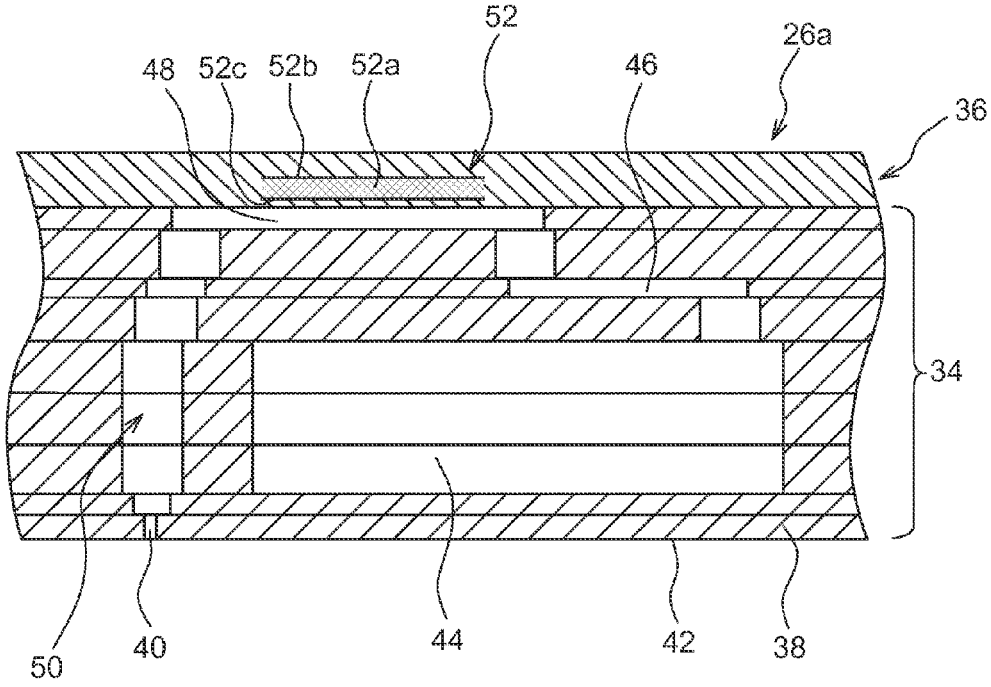
FIG. 5 is a partial sectional view of one of the head units of the ink ejection head in the illustrative embodiment, according to one or more aspects of the disclosure.

The head units 26*a*, 26*b*, 26*c*, 26*d*, 26*e*, and 26*f* may have the same configuration to ensure uniform ink ejection properties and to reduce manufacturing costs. Therefore, the configuration of each of the head units 26*a*, 26*b*, 26*c*, 26*d*, 26*e*, and 26*f* is described below with reference to the first head unit 26*a*. As depicted in FIG. 5, the first head unit 26*a* may comprise a channel unit 34 and an actuator unit 36 joined to an upper surface of the channel unit 34. The channel unit 34 may be a laminated body comprising a plurality of plates made of metal, wherein a lower surface of a plate 38 that may be a lowermost layer of the laminated body may comprise the ejection surface 42 having the plurality of ejection nozzles 40 for ejecting ink (i.e., liquid) to record an image. The channel unit 34 may comprise therein a manifold 44 and a plurality of ink channels 50. Each ink channel 50 may extend from the manifold 44 to a corresponding ejection nozzle 40 through a corresponding aperture 46 and a corresponding pressure chamber 48. The channel unit 34 may have an ink outlet (not depicted) in its upper surface, and the ink outlet may be in fluid communication with the manifold 44.

As depicted in FIG. 5, the actuator unit 36 may comprise a plurality of drive portions 52. Each drive portion 52 may comprise a piezoelectric layer 52*a* corresponding to the pressure chamber 48, and a pair of electrodes 52*b* and 52*c* that may sandwich the piezoelectric layer 52*a* therebetween. The control device 24 (see FIG. 3) may be electrically connected to the electrodes 52*b* and 52*c* via a flexible circuit board (not depicted) equipped with a driver integrated circuit ("IC") (not depicted). Upon application of voltage between the electrodes 52*b* and 52*c* by the control device 24 (see FIG. 3), a volume of the pressure chamber 48 may be changed and ejection energy may be applied to ink stored in the pressure chamber 48. The ejection energy may cause ink to be ejected from the ejection nozzle 40. An voltage application frequency per unit time may be controlled by the control device 24 (see FIG. 3). As the voltage application frequency per unit time becomes higher, an ink ejection amount per unit time may be increased.

Figure 3:
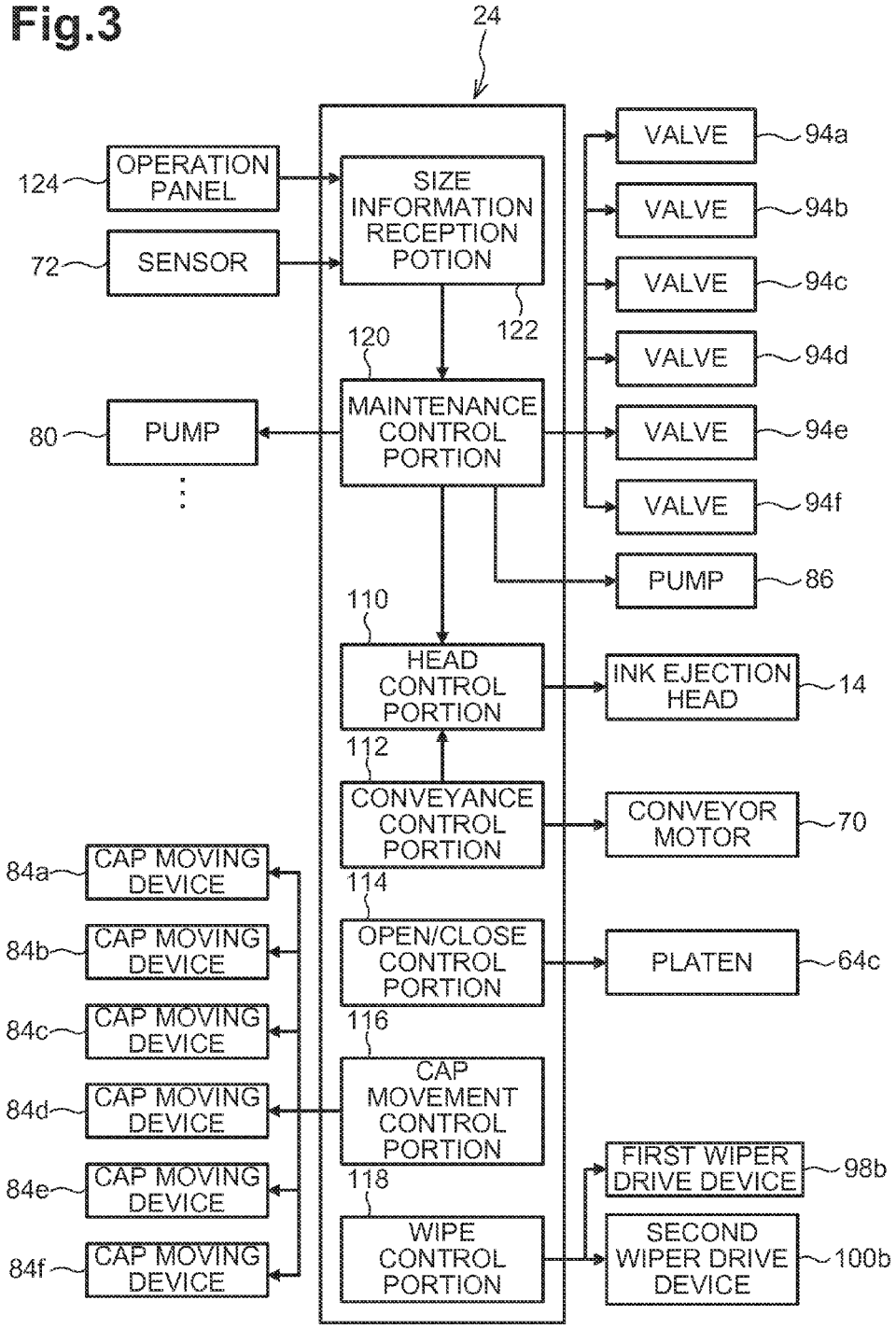
FIG. 3 is a block diagram depicting the configuration of the inkjet printer in the illustrative embodiment, according to one or more aspects of the disclosure.

As depicted in FIG. 1, the conveyor mechanism 16 may comprise a sheet storage portion 56, a sheet output portion 58, a conveyance force application device 62, and a platen 64, and may have a conveyance path 60 therein. The sheet storage portion 56 may be disposed inside the housing 12. The sheet output portion 58 may be disposed at an upper surface of the housing 12. The conveyance force application device 62 may be configured to apply a conveyance force to a sheet P. The platen 64 may be configured to support a sheet P in the recording area Q. The conveyance path 60 may define a sheet conveyance route from the sheet storage portion 56 to the sheet output portion 58 via the recording area Q. The conveyance path 60 may have a horizontal path 60*a* for conveying a sheet P in a horizontal direction in the recording area Q. The conveyance force application device 62 may comprise a plurality of conveyor roller pairs 66*a*, 66*b*, 66*c*, 66*d*, 66*e*, 66*f*, 66*g*, and 66*h*, a pickup roller 68, and a conveyor motor 70 (see FIG. 3). The pickup roller 68 may be configured to pick up a sheet P from the sheet storage portion 56 to feed the sheet P into the conveyance path 60. The conveyor motor 70 may be a power source for sheet conveyance. The platen 64 may comprise a plurality of, for example, two, plate-like door members 64*a* and 64*b*, and a platen opening/closing device 64*c* configured to open and close the door members 64*a* and 64*b*. At the time of recording an image onto a sheet P, the door members 64*a* and 64*b* may be closed to support the sheet P conveyed to the recording area Q. A sensor 72 may be disposed in an area upstream of the recording area Q in the conveyance path 60. The sensor 72 may be configured to detect the second directional dimension of a sheet P conveyed by the conveyor mechanism 16. In the illustrative embodiment, the sensor 72 may be a line sensor configured to detect an entire dimension of the sheet P in the second direction. As depicted in FIG. 3, the control device 24 (see FIG. 3) may be electrically connected to the conveyor motor 70, the platen opening/closing device 64*c*, and the sensor 72, and the operations of the conveyor mechanism 16 may be controlled by the control device 24 (see FIG. 3).

As depicted in FIG. 2, the ink supply mechanism 18 may comprise a plurality of, for example, four, ink tanks 74*a*, 74*b*, 74*c*, and 74*d*, a plurality of, for example, four, tank mount portions 76*a*, 76*b*, 76*c*, and 76*d*, a plurality of, for example, twenty-four, ink tubes 78, and a plurality of pumps 80. Each of the ink tanks 74*a*, 74*b*, 74*c*, and 74*d* may be configured to store ink of one of colors to be supplied to the ink ejection head 14. The tank mount portions 76*a*, 76*b*, 76*c*, and 76*d* may be configured such that the ink tanks 74*a*, 74*b*, 74*c*, and 74*d* may be removably attached thereto, respectively. Each ink tube 78 may be configured to supply ink stored in a corresponding one of the ink tanks 74*a*, 74*b*, 74*c*, and 74*d* mounted on the tank mount portions 76*a*, 76*b*, 76*c*, and 76*d*, respectively, to a corresponding one of the head units 26*a*, 26*b*, 26*c*, 26*d*, 26*e*, and 26*f*. The plurality of pumps 80 may be provided for the plurality of ink tubes 78, respectively. Each pump 80 may function as a "pressure application device" configured to apply pressure to ink stored in the manifold 44 (see FIG. 5) corresponding to each of the ejection nozzle rows 32*a*, 32*b*, 32*c*, and 32*d* (see FIG. 4) of each of the head units 26*a*, 26*b*, 26*c*, 26*d*, 26*e*, and 26*f* at the time of maintenance. Although each pump 80 is not driven during printing operation, in each ink channel, an ink channel disposed upstream of the pump 80 and an ink channel disposed downstream of the pump 80 may be in fluid communication with each other.

Figure 6:
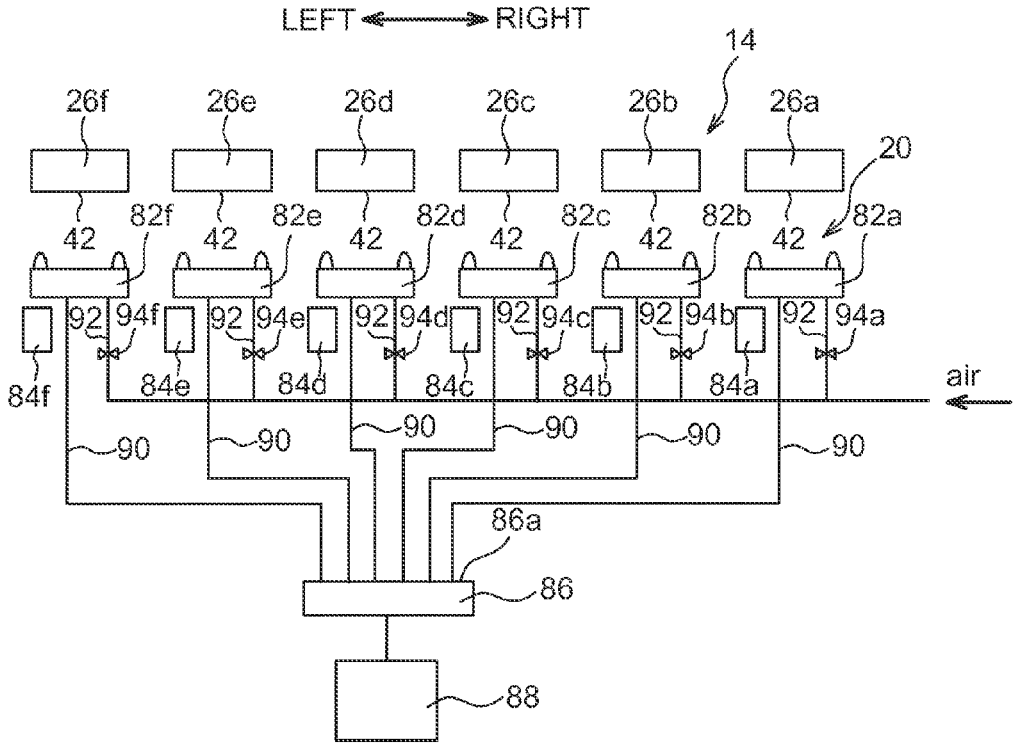
FIG. 6 depicts a configuration of a purge mechanism in the illustrative embodiment, according to one or more aspects of the disclosure.

As depicted in FIG. 6, the purge mechanism 20 may comprise a plurality of caps 82*a*, 82*b*, 82*c*, 82*d*, 83*e*, and 82*f*, a plurality of cap moving devices 84*a*, 84*b*, 84*c*, 84*d*, 84*e*, and 84*f*, a pump 86, and an ink tank 88. Each of the caps 82*a*, 82*b*, 82*c*, 82*d*, 83*e*, and 82*f* may be configured to cover or seal hermetically the ejection surface 42 of a corresponding one of the plurality of head units 26*a*, 26*b*, 26*c*, 26*d*, 26*e*, and 26*f*. Each of the cap moving devices 84*a*, 84*b*, 84*c*, 84*d*, 84*e*, and 84*f* may be configured to move a corresponding one of the caps 82*a*, 82*b*, 82*c*, 82*d*, 83*e*, and 82*f* up and down. The pump 86 may be configured to cause the pressure in an interior space of each of the caps 82*a*, 82*b*, 82*c*, 82*d*, 83*e*, and 82*f* to be negative when the caps 82*a*, 82*b*, 82*c*, 82*d*, 83*e*, and 82*f* cover the respective ejection surfaces 42 hermetically. The ink tank 88 may be configured to store ink sucked by the pump 86. In the illustrative embodiment, the interior space of each of the caps 82*a*, 82*b*, 82*c*, 82*d*, 83*e*, and 82*f* and a suction port 86*a* of the pump 86 may be in fluid communication with each other via a corresponding one of ink tubes 90, and the interior space of each of the caps 82*a*, 82*b*, 82*c*, 82*d*, 83*e*, and 82*f* and exterior space may be in fluid communication with each other via a corresponding one of air supply tubes 92. The air supply tubes 92 may comprise valves 94*a*, 94*b*, 94*c*, 94*d*, 94*e*, and 94*f*, respectively, corresponding to the respective caps 82*a*, 82*b*, 82*c*, 82*d*, 83*e*, and 82*f*. Although the caps 82*a*, 82*b*, 82*c*, 82*d*, 83*e*, and 82*f* overlap each other in the second direction in reality, the caps 82*a*, 82*b*, 82*c*, 82*d*, 83*e*, and 82*f* are illustrated without overlapping each other in the second direction in FIG. 6 for convenience of description.

For example, in order to cover the ejection surface 42 of the first head unit 26*a* hermetically with the cap 82*a*, first, the door members 64*a* and 62*b* may be opened and then the cap 82*a* may be moved upward by the cap moving mechanism 84*a* to make a circumferential edge portion of the cap 82*a* contact with the ejection surface 42 of the first head unit 26*a*. In order to discharge ink from the ejection nozzles 40 of the first head unit 26*a*, the pump 86 may be driven while the valve 94*a* corresponding to the cap 82*a* may be closed. Thus, the pressure in the interior space of the cap 82*a* may become negative and ink stored in the first head unit 26*a* may be drawn from the ejection nozzles 40 by the negative pressure. In order to discharge ink pooled in the interior space of the cap 82*a*, the pump 86 may be driven while the valve 94*a* corresponding to the cap 82*a* may be opened. Then, air may be taken into the interior space of the cap 82*a* via the corresponding air supply tube 92, and thus, ink may be discharged into the ink tank 88 by the suction of the pump 86 together with air. As depicted in FIG. 3, the control device 24 may be electrically connected to the cap moving devices 84*a*, 84*b*, 84*c*, 84*d*, 84*e*, and 84*f*, the valves 94*a*, 94*b*, 94*c*, 94*d*, 94*e*, and 94*f*, and the pump 86. The operations of the purge mechanism 20 (see FIG. 6) may be controlled by the control device 24.

As depicted in FIG. 4, the wiper mechanism 22 may comprise a first wiper unit 98 and a second wiper unit 100. The first wiper unit 98 may be configured to perform a wiping process in which each ejection surface 42 (see FIG. 5) of the first head unit 26*a*, the third head unit 26*c*, and the fifth head unit 26*e* constituting the first head row 30*a* may be wiped from the left to the right. The second wiper unit 100 may be configured to perform a wiping process in which each ejection surface 42 (see FIG. 5) of the second head unit 26*b*, the fourth head unit 26*d*, and the sixth head unit 26*f* constituting the second head row 30*b* may be wiped from the right to the left. As depicted in FIGS. 2 and 4, the first wiper unit 98 may comprise a first wiper 98*a* and a first wiper drive device 98*b*. The first wiper 98*a* may be configured to wipe foreign matter adhered to the ejection surfaces 42 (see FIG. 5) therefrom. The first wiper drive device 98*b* may be configured to move the first wiper 98*a* in the first direction and an up-down direction. As depicted in FIG. 4, the second wiper unit 100 may comprise a second wiper 100*a* and a second wiper drive device 100*b*. The second wiper 100*a* may be configured to wipe foreign matter adhered to the ejection surfaces 42 (see FIG. 5) therefrom. The second wiper drive device 100*b* may be configured to move the second wiper 100*a* in the first direction and the up-down direction. As depicted in FIG. 3, the control device 24 may be electrically connected to the first wiper drive device 98*b* and the second wiper drive device 100*b*. The operations of the first wiper 98*a* and the second wiper 100*a* may be controlled by the control device 24.

The control device 24 depicted in FIG. 1 may comprise a central processing unit ("CPU"), a nonvolatile memory, and a random access memory ("RAM"). The nonvolatile memory may store control programs executed by the CPU and various rewritable data. The RAM may be configured to temporarily store data during execution of the control program. As depicted in FIG. 3, a function of each of a head control portion 110, a conveyance control portion 112, an open/close control portion 114, a cap movement control portion 116, a wiper control portion 118, a maintenance control portion 120, and a size information reception portion 122 may be implemented by the CPU that may execute the control programs stored in the nonvolatile memory. That is, the control programs may allow a computer (i.e., the control device 24) to function as a control device configured to control the ink ejection head 14 (see FIG. 1), the conveyor mechanism 16 (see FIG. 1), the purge mechanism 20 (see FIG. 6) as the "liquid discharging device", and the wiper mechanism 22 (see FIGS. 4 and 8).

Hereinafter, referring to FIG. 7, a control operation of the inkjet printer 10 carried out by the control device 24 (see FIG.

3) is described. When the inkjet printer 10 is used, an image information input device (not depicted) such as a personal computer or a storage medium may be connected to the inkjet printer 10. Then, the inkjet printer 10 may record an image onto a sheet P based on image information received from the image information input device (not depicted).

Figure 7:
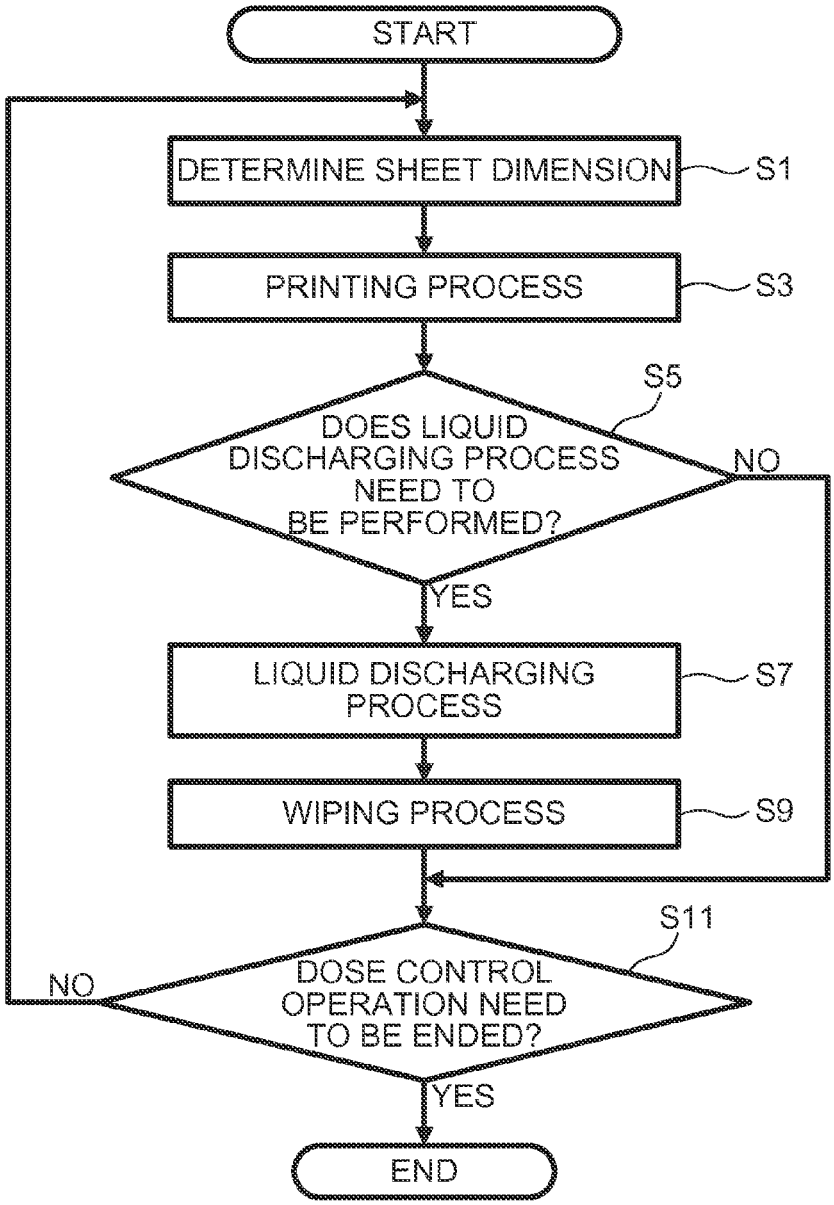
FIG. 7 is a flowchart of a control operation of the inkjet printer in the illustrative embodiment, according to one or more aspects of the disclosure.

As depicted in FIG. 7, as the control device 24 starts the control operation, first, in step S1, the control device 24 (see FIG. 3) may determine a second directional dimension of a sheet P to be conveyed by the conveyor mechanism 16. As depicted in FIG. 3, the control device 24 according to the illustrative embodiment may comprise the size information reception portion 122 as a "size information reception device" configured to receive information about the size of the sheet P to be recorded with an image by the ink ejection head 14 from the sensor 72. The control device 24 may determine the second directional dimension of the sheet P to be conveyed by the conveyor mechanism 16 based on the size of the sheet P received from the size information reception portion 122. In other embodiments, for example, the size information reception portion 122 may be configured to receive the second directional dimension of the sheet P through an input via an operation panel 124 disposed on the housing 12 (see FIG. 1) or may be configured to receive the second directional dimension of the sheet P included in the image information received from the image information input device (not depicted).

The control device 24 (see FIG. 3) may determine one or more "first ejection nozzles" based on the second directional dimension of the sheet P. Each of one or more ejection nozzles 40, which may correspond to one or the other of the edges of the sheet P (e.g., a recording medium) in the second direction whose second directional dimension has been determined, of the plurality of ejection nozzles 40 may be determined as a "first ejection nozzle". For example, an edge portion may be an area adjacent to one or more edges and may include an area inside the edge, an area outside the edge, or both. The control device 24 may further determine one or more "second ejection nozzles". Each of one or more ejection nozzles 40, which may correspond to an inward area of the sheet P in the second direction than the areas corresponding to the one or more "first ejection nozzles", of the plurality of ejection nozzles 40 may be determined as a "second ejection nozzle". Furthermore, the control device 24 may determine one or more "third ejection nozzles". Each of one or more ejection nozzles 40, which may correspond to outward areas of the sheet P in the second direction than the areas corresponding to the one or more "first ejection nozzles", of the plurality of ejection nozzles 40 may be determined as a "third ejection nozzle". The "first ejection nozzle" may be an ejection nozzle 40 that may be the most likely to attract paper dust of the sheet P. The "third ejection nozzle" may be an ejection nozzle 40 that may be second likely to attract paper dust of the sheet P. The "second ejection nozzle" may be an ejection nozzle 40 that may be less likely to attract paper dust of the sheet P than the first and third ejection nozzles. In the illustrative embodiment, the "first ejection nozzles", the "second ejection nozzles", and the "third ejection nozzles" may be determined on a head unit basis.

For example, when a second directional dimension of a sheet P2 having a minimum dimension in the second direction is determined, the control device 24 (see FIG. 3) may determine, as a "first ejection nozzle", each of the plurality of ejection nozzles 40 included in the second head unit 26*b* and the fifth head unit 26*e* that may include one or more ejection nozzles 40, which may correspond to one or the other of the edges of the sheet P2 in the second direction, of the plurality of ejection nozzles 40. The control device 24 (see FIG. 3) may determine, as a "second ejection nozzle", each of the plurality of ejection nozzles 40 included in the third head unit 26*c* and the fourth head unit 26*d* that may include one or more ejection nozzles 40, which may correspond to an inward area of the sheet P2 in the second direction than the areas corresponding to the one or more "first ejection nozzles", of the plurality of ejection nozzles 40. The control device 24 (see FIG. 3) may determine, as a "third ejection nozzle", each of the plurality of ejection nozzles 40 included in the first head unit 26*a* and the sixth head unit 26*f* that may include one or more ejection nozzles 40, which may correspond to one or the other of outward areas of the sheet P2 in the second direction than the areas corresponding to the one or more "first ejection nozzles", of the plurality of ejection nozzles 40. When a second directional dimension of a sheet P1 having a maximum dimension in the second direction is determined, the control device 24 (see FIG. 3) may determine that there is no ejection nozzle 40 that may correspond to one or the other of the edges of the sheet P1 in the second direction and thus might not determine a "first ejection nozzle", a "second ejection nozzle", and a "third ejection nozzle".

In step S3, the control device 24 (see FIG. 3) may control the ink ejection head 14 and the conveyor motor 70 to perform a printing process on the sheet P. That is, the control device 24 (see FIG. 3) may control the conveyor motor 70 of the conveyor mechanism 16 to feed the sheet P to the recording area Q (see FIG. 1) at a predetermined timing while controlling the ink ejection head 14 to eject ink from one or more ejection nozzles 40 (see FIG. 5) onto the sheet P fed to the recording area Q (see FIG. 1).

After the printing process is performed, foreign matter (e.g., paper dust, ink, and/or dust particles) may adhere to the ejection surfaces 42 of the head units 26*a*, 26*b*, 26*c*, 26*d*, 26*e*, and 26*f* and viscosity of ink may increase in one or more ejection nozzles 40 whose ink ejection frequencies may be relatively low as time elapses. These phenomenon may cause a deterioration of ink ejection performance of the ink ejection head 14. Accordingly, the control device 24 (see FIG. 3) may control an appropriate one or more of the cap moving devices 84*a*, 84*b*, 84*c*, 84*d*, 84*e*, and 84*f* to hermetically cover one or more ejection nozzles 40 (e.g., the one or more third ejection nozzles in the illustrative embodiment), which might not correspond to the sheet P, of the plurality of ejection nozzles 42 (FIG. 5) in a series of printing operations that may include a conveyance operation of the sheet P by the conveyor mechanism 16 and an image recording operation using the ink ejection head 14, with a corresponding one or more of the caps 82*a*, 82*b*, 82*c*, 82*d*, 83*e*, and 82*f*. The corresponding one or more of the caps 82*a*, 82*b*, 82*c*, 82*d*, 83*e*, and 82*f* used in the series of printing operations may be a "first cap". The control device 24 (see FIG. 3) may perform a liquid discharging process at predetermined periods to restore the ink ejection performance in step S7.

In step S5, the control device 24 (see FIG. 3) may determine whether the liquid discharging process in step S7 needs to be performed. That is, in the illustrative embodiment, the control device 24 may determine whether the time to perform the liquid discharging process has come. When the control device 24 (see FIG. 3) makes a position determination (e.g., YES in step S5), routine may proceed to step S11, subsequent to steps S7 and S9. When the control device makes a negative determination (e.g., NO in step S5), routine may proceed to step S11 with skipping step S7 and S9.

In step S7, the control device 24 (see FIG. 3) may control the purge mechanism 20 (see FIG. 6) as the "liquid discharging device" to perform the liquid discharging process. As depicted in FIG. 7, the liquid discharging process may be performed subsequent to steps S1 and S3, that is, after an image is recorded using the ink ejection head 14 on the sheet P whose second directional dimension was determined.

When one or more "first ejection nozzles" and one or more "second ejection nozzles" have been determined in step S1, the control device 24 (see FIG. 3) may control the purge mechanism 20 (see FIG. 6) such that an amount of ink to be discharged from each of the one or more "first ejection nozzles" may be larger than an amount of ink to be discharged from each of the one or more "second ejection nozzles". When one or more "third ejection nozzles" have also been determined in step S1, the control device 24 (see FIG. 3) may control the purge mechanism 20 (see FIG. 6) such that the "first ejection nozzle" may discharge the largest amount of ink, the "third ejection nozzle" may discharge the second largest amount of ink, and the "second ejection nozzle" may discharge the least amount of ink thereamong. As described above, the amount of ink discharged from the ejection nozzle 40 that may be more likely to attract paper dust may be increased. Thus, paper dust may be effectively removed from the ejection surfaces 42 while the amount of ink discharged from the plurality of ejection nozzles 40 may be restricted as a whole. When no "first ejection nozzle" and no "second ejection nozzle" are determined, the control device 24 (see FIG. 3) may control the purge mechanism 20 (FIG. 6) such that the amount of ink discharged from each of the plurality of ejection nozzles 40 may be the same.

The liquid discharging process according to the illustrative embodiment may comprise a maintenance process that may be performed after an image is recorded using the ink ejection head 14 on the sheet P whose second directional dimension has been determined. The control device 24 (see FIG. 3) may control the purge mechanism 20 (see FIG. 6) such that an amount of ink discharged from each of the one or more "first ejection nozzles" in the maintenance process may be larger than an amount of ink discharged from each of the one or more "second ejection nozzles" in the maintenance process. Further, the control device 24 (see FIG. 3) may control the purge mechanism 20 (see FIG. 6) such that the "first ejection nozzle" may discharge the largest amount of ink, the "third ejection nozzle" may discharge the second largest amount of ink, and the "second ejection nozzle" may discharge the least amount of ink thereamong in the maintenance process. In the purge mechanism 20 (see FIG. 6) according to the illustrative embodiment, the pump 86 may be driven longer to increase the amount of ink discharged from the one or more ejection nozzles 40 (see FIG. 5) corresponding to an appropriate one or more of the plurality of caps 82*a*, 82*b*, 82*c*, 82*d*, 83*e*, and 82*f* while one or more of the valves 94*a*, 94*b*, 94*c*, 94*d*, 94*e*, and 94*f* (see FIG. 6) corresponding to the appropriate one or more of the plurality of caps 82*a*, 82*b*, 82*c*, 82*d*, 83*e*, and 82*f* may be closed. In addition, the amount of ink discharged from each of the one or more "second ejection nozzles" in the maintenance process may be greater than or equal to zero.

A longer period of ink discharging may make paper dust adhered to the ejection surfaces 42 get more wet, and thus, paper dust may be removed therefrom more readily. Therefore, for example, the control device 24 (see FIG. 3) may be configured to control the purge mechanism 20 (see FIG. 6) such that the time required to discharge ink from the "first ejection nozzle" may become longer than the time required to discharge ink from the "second ejection nozzle". Although the "first ejection nozzle" and the "second ejection nozzle" discharge the same amount of ink therefrom, one ejection surface 42 having the ejection nozzles 40 that may discharge ink for a longer period than another ejection surface 42 (i.e., a flow rate per unit time may be low) may be more likely to get wet with ink, whereby paper dust adhered to the one ejection surface 42 may be removed therefrom easily.

In other embodiments, it is assumed that a cap that covers the one or more "first ejection nozzles" hermetically at the time of the liquid discharging process is a "second cap". In this case, when the inside of the "second cap" becomes full of ink, paper dust adhered to the ejection surface 42 having the one or more "first ejection nozzles" may more likely to get wet or soak in the ink, whereby paper dust may be removed therefrom easily. Therefore, the control device 24 (see FIG. 3) may be configured to control the purge mechanism 20 (see FIG. 6) to discharge a sufficient amount of ink that may fill the "second cap" with ink from the one or more "first ejection nozzles".

In other embodiments, for example, the liquid discharging process may comprise a first maintenance process for discharging ink from the one or more "first ejection nozzles" and a second maintenance process for discharging ink from the one or more "second ejection nozzles". In this case, the control device 24 (see FIG. 3) may control the purge mechanism 20 (see FIG. 6) such that a frequency of performing the first maintenance process may become higher than a frequency of performing the second maintenance process as well as performing one or both of the first maintenance process and the second maintenance process between after image recording on one sheet P by the ink ejection head 14 has been completed and before image recording on another sheet P subsequent to the one sheet P by the ink ejection head 14 is started, wherein the one and another sheets P may be included in the plurality of sheets P having the same second directional dimension. In this case, paper dust adhered to an area of the ejection surface 42 having the one or more "first ejection nozzles" may be removed easily because the frequency of performing the first maintenance process is higher than the frequency of performing the second maintenance process even when the amount of ink discharged in the first maintenance process is the same as the amount of ink discharged in the second maintenance process.

Figure 8A:
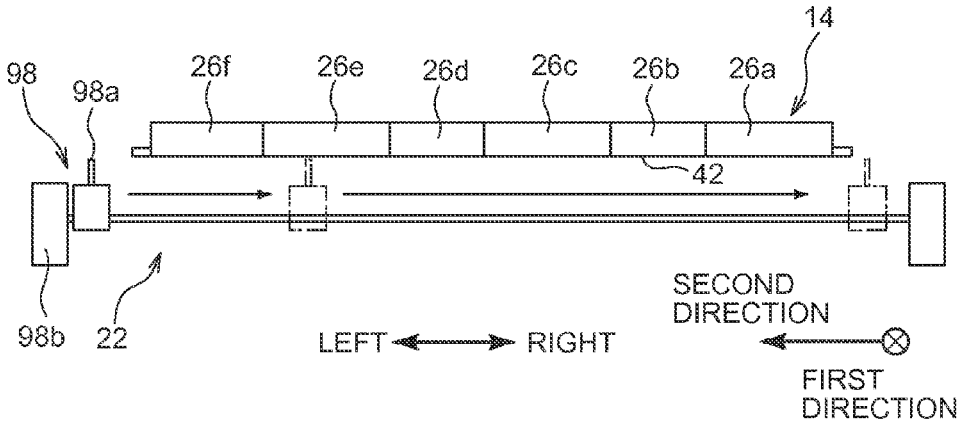
FIG. 8A depicts a first wiping operation by the wiper mechanism in the illustrative embodiment, according to one or more aspects of the disclosure.
Figure 8B:
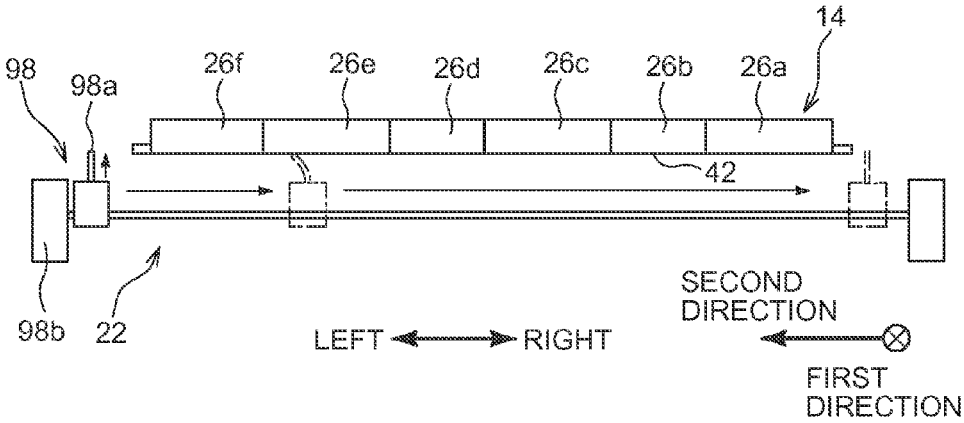
FIG. 8B depicts a second wiping operation by the wiper mechanism in the illustrative embodiment, according to one or more aspects of the disclosure.

In step S9, the control device 24 (see FIG. 3) may control the wiper mechanism 22 (see FIG. 2) to perform a wiping process. As depicted in FIGS. 8A and 8B, the control device 24 (see FIG. 3) control the first wiper 98*a* to perform a first wiping operation (see FIG. 8A) and a second wiping operation (see FIG. 8B) sequentially in this order. In the first wiping operation, the first wiper 98*a* may be moved with respect to a first area including at least the one or more "first ejection nozzles" of the ejection surface 42 while a slight clearance may be left between a tip of the first wiper 98*a* and the first area. In the second wiping operation, the first wiper 98*a* may be moved with respect to the first area with being in contact with the first area. In FIGS. 8A and 8B, although the operation of the first wiper 98*a* is depicted, the second wiper 100*a* (see FIG. 4) may be operated in the same manner. As described above, paper dust may be wiped in two stages with respect to the first area including the one or more "first ejection nozzles" of the ejection surface 42. Accordingly, paper dust may be effectively removed from the ejection surface 42. That is, paper dust included in ink adhered to the ejection surface 42 may be removed therefrom in the first wiping operation, and then the ejection surface 42 may be wiped in the second wiping operation subsequent to the first wiping operation. Thus, paper dust may less likely to remain on the ejection surfaces 42 after wiping.

A period between a completion of the discharging operation of ink from the one or more "first ejection nozzles" by the purge mechanism 20 (see FIG. 6) and a completion of the wiping operation in which the first wiper 98*a* and the second wiper 100*a* may wipe the first areas including the one or more "first ejection nozzles" of the one or more ejection surfaces 42 may be referred to as a period T1. A period between a completion of the discharging operation of ink from the one or more "second ejection nozzles" by the purge mechanism 20 (see FIG. 6) and a completion of the wiping operation in which the first wiper 98*a* and the second wiper 100*a* may wipe second areas including the one or more "second ejection nozzles" of the one or more ejection surfaces 42 may be referred to as a period T2. In this case, the control device 24 (see FIG. 3) may control the first wiper 98*a* and the second wiper 100*a* such that the period T1 may be longer than the period T2. Therefore, paper dust adhered to the first areas including the one or more "first ejection nozzles" may get wet enough by ink, and thus, paper dust may be removed effectively therefrom.

As depicted in FIG. 4, the control device 24 (see FIG. 3) may control the first wiper 98*a* to perform the wiping process to wipe the ejection surfaces 42 (see FIG. 5) of the respective head units 26*a*, 26*c*, and 26*e* constituting the first head row 30*a* from the left to the right and also control the second wiper 100*a* to perform the wiping process to wipe the ejection surfaces 42 (see FIG. 5) of the respective head units 26*b*, 26*d*, and 26*f* constituting the second head row 30*b* from the right to the left. That is, the control device 24 (see FIG. 3) may control the first wiper 98*a* and the second wiper 100*a* to move in a direction from the inside to the outside of the sheet P in the respective first areas (e.g., each of the ejection surfaces 42 of the first head unit 26*a* and the sixth head unit 26*f*) including the one or more "first ejection nozzles" arranged in the end portions of the ejection surfaces 42 (see FIG. 5) in the second direction. With this configuration, paper dust moved along the ejection surfaces 42 by the first wiper 98*a* and the second wiper 100*a* may be restricted to adhere to the sheet P after wiping.

In step S11, the control device 24 (see FIG. 3) may determine whether the control operation needs to be ended. When the control device 24 determines that the control operation needs to be ended, the control device 24 may end the control operation, and otherwise, routine may return to step S1.

In the illustrative embodiment, the liquid discharging process in which the amount of ink discharged from the one or more "first ejection nozzles" may become larger than the amount of ink discharged from the one or more "second ejection nozzles" may be performed in accordance with the second directional dimension of the sheet P. Therefore, the amount of ink discharged from the one or more "first ejection nozzles" may be increased while the discharge amount of ink discharged from the plurality of ejection nozzles 40 may be restricted as a whole. Accordingly, paper dust adhered to the first areas including the one or more "first ejection nozzles" may be removed effectively while the maintenance costs may be reduced.

While the disclosure has been described in detail with reference to the specific embodiment thereof, this is merely an example, and various changes, arrangements and modifications may be applied therein without departing from the spirit and scope of the disclosure. In the above-described illustrative embodiment, the "liquid discharging device" may comprise the purge mechanism 20 (see FIG. 6) as a "suction device" configured to suction ink from at least one ejection nozzle 40 of the plurality of ejection nozzles 40 by negative pressure suction. Nevertheless, in other embodiments, for example, the "liquid discharging device" may comprise the pump 80 (see FIG. 2) as the "pressure application device" configured to discharge ink from at least one ejection nozzle 40 of the plurality of ejection nozzles 40 by application of positive pressure. The "liquid discharging device" may comprise the control device 24 (see FIG. 3) as a "drive device" configured to drive the ink ejection head 14 to allow at least one ejection nozzle 40 of the plurality of ejection nozzles 40 to eject ink therefrom. In this case, ink ejection may be controlled on an ejection nozzle 40 basis. Thus, the "first ejection nozzle", the "second ejection nozzle", and the "third ejection nozzle" may be determined on an ejection nozzle 40 basis.

Figure 9:
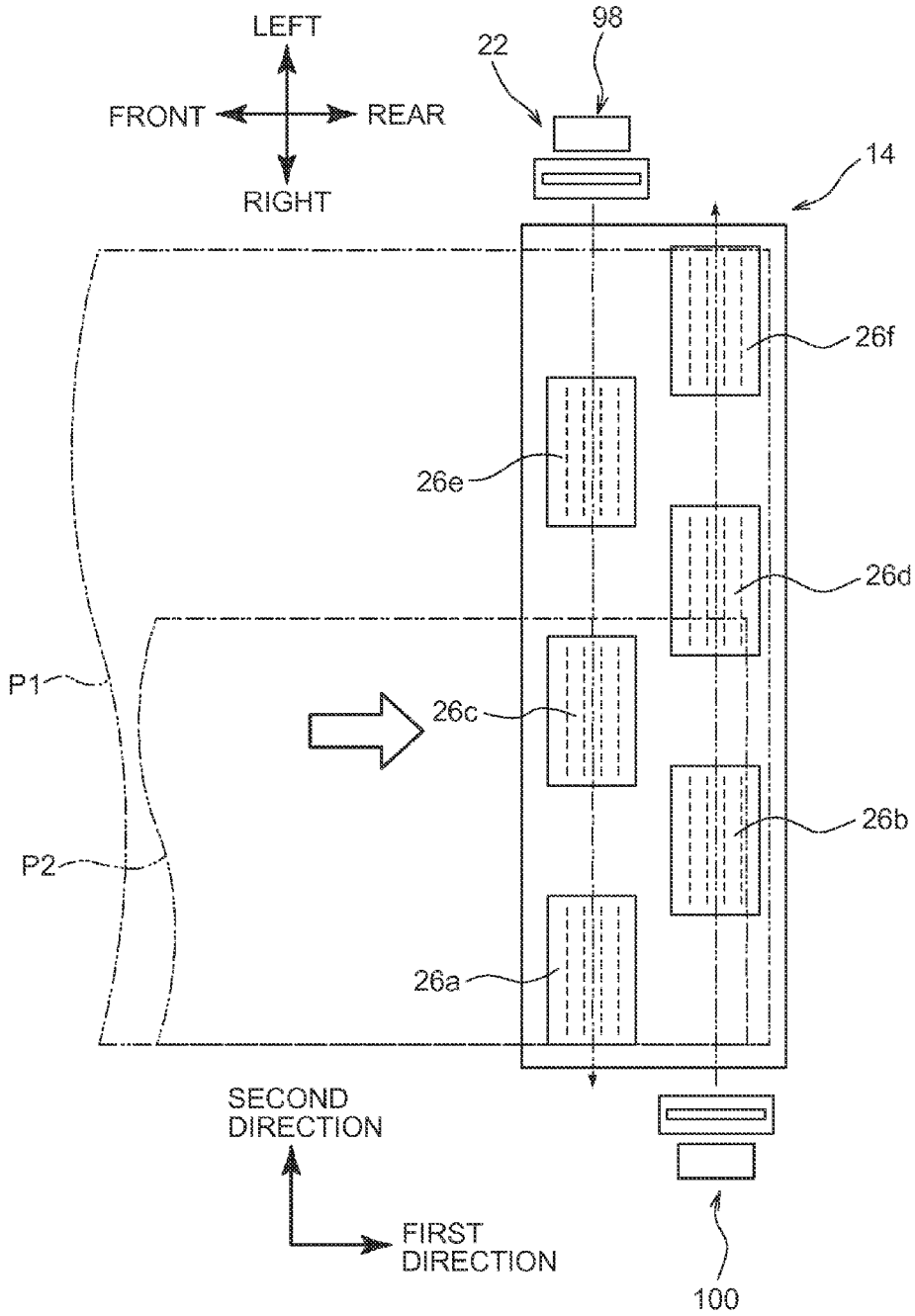
FIG. 9 is a plan view depicting a positional relationship (in a case of side alignment) between each head unit of the ink ejection head and each of sheets having different sizes conveyed by a conveyor mechanism in the illustrative embodiment, according to one or more aspects of the disclosure.

As depicted in FIG. 4, in the above-described embodiment, the "center alignment" in which a center line of each of the sheets P1 and P2 may be aligned with the center line of the ink ejection head 14 in the second direction may be adopted. Nevertheless, in other embodiments, as depicted in FIG. 9, a "side alignment" in which one side edge of each of the sheets P1 and P2 may be aligned with one side end of the ink ejection head 14 in the second direction may be adopted.

Figure 10:
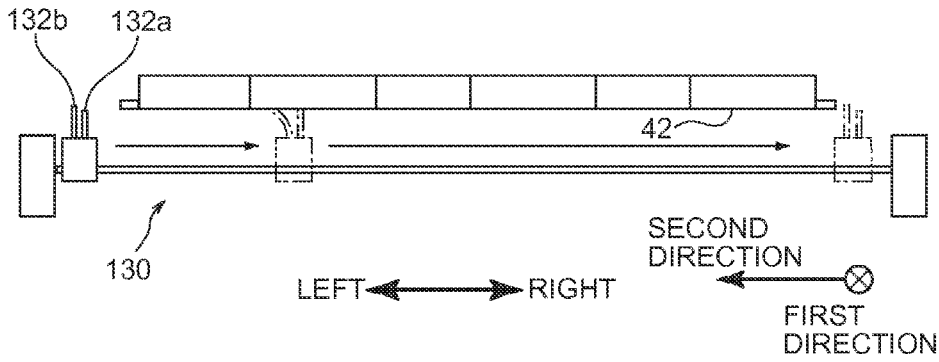
FIG. 10 depicts a configuration of another wiper mechanism and an operation of the another wiper mechanism in another illustrative embodiment, according to one or more aspects of the disclosure.

In other embodiments, for example, as depicted in FIG. 10, a wiper mechanism 130 may comprise a first wiper 132*a* and a second wiper 132*b* that may have respective different heights and may be arranged side by side in the first direction. As depicted in FIG. 10, the second wiper 132*b* may have a height greater than the first wiper 132*a*. In this case, the control device 24 (see FIG. 3) may control the first wiper 132*a* and the second wiper 132*b* such that the second wiper 132*b* may be moved with respect to the first area including the one or more "first ejection nozzles" of the ejection surface 42 with its tip being in contact with the first area immediately after the first wiper 132*a* is moved with a slight clearance left between the tip of the first wiper 132*a* and the first area. In this case, also, paper dust may be wiped off from the first area including the one or more "first ejection nozzles" of the ejection surface 42 in the two stages. Therefore, paper dust may be removed effectively. In other embodiments, in the wiping process, an ordinary wiping process (i.e., one stage) may be performed instead of the two-stage wiping process described above.

Figure 11:
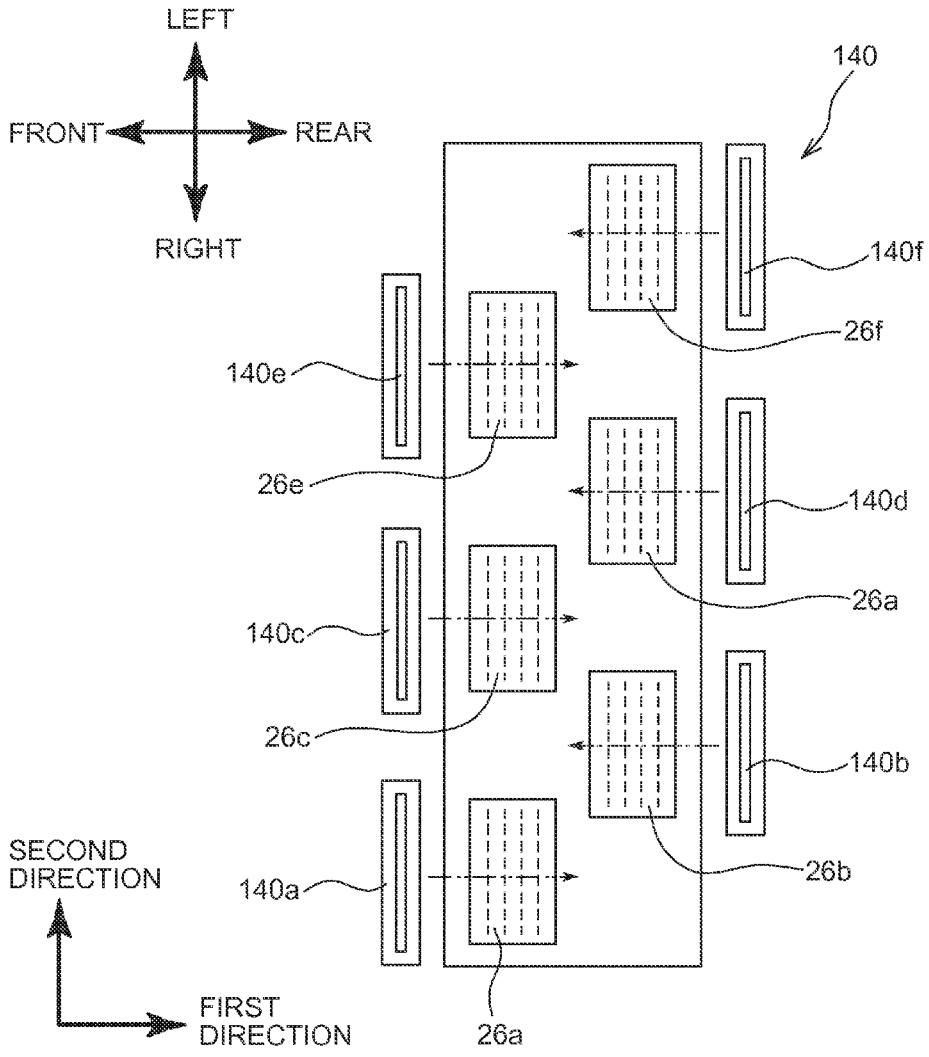
FIG. 11 depicts a configuration of a further wiper mechanism and an operation of the further wiper mechanism in a further illustrative embodiment, according to one or more aspects of the disclosure.

In other embodiments, for example, as depicted in FIG. 11, a wiper mechanism 140 may comprise wipers 140*a*, 140*b*, 140*c*, 140*d*, 140*e*, and 140*f* corresponding to the plurality of head units 26*a*, 26*b*, 26*c*, 26*d*, 26*e*, and 26*f*, respectively. In the embodiment depicted in FIG. 11, each of the wipers 140*a*, 140*b*, 140*c*, 140*d*, 140*e*, and 140*f* may be configured to move along the first direction, and the control device 24 (see FIG. 3) may control the wipers 140*a*, 140*b*, 140*c*, 140*d*, 140*e*, and 140*f* to move along the first direction in the first area including the one or more "first ejection nozzles" of at least the ejection surface 42. In the line-type ink ejection head 14, a number of ejection nozzles 40 (see FIG. 5) arranged in the first direction may be less than a number of ejection nozzles 40 (see FIG. 5) arranged in the second direction. Therefore, the wipers 140*a*, 140*b*, 140*c*, 140*d*, 140*e*, and 140*f* may be moved in the first direction. With this movement, paper dust moved along the at least the ejection surface 42 by the wipers 140*a*, 140*b*, 140*c*, 140*d*, 140*e*, and 140*f* may be reduced or prevented from clogging one or more ejection nozzles 40 (see FIG. 5) defined in a downstream position in a wiper movement direction.

Figure 12:
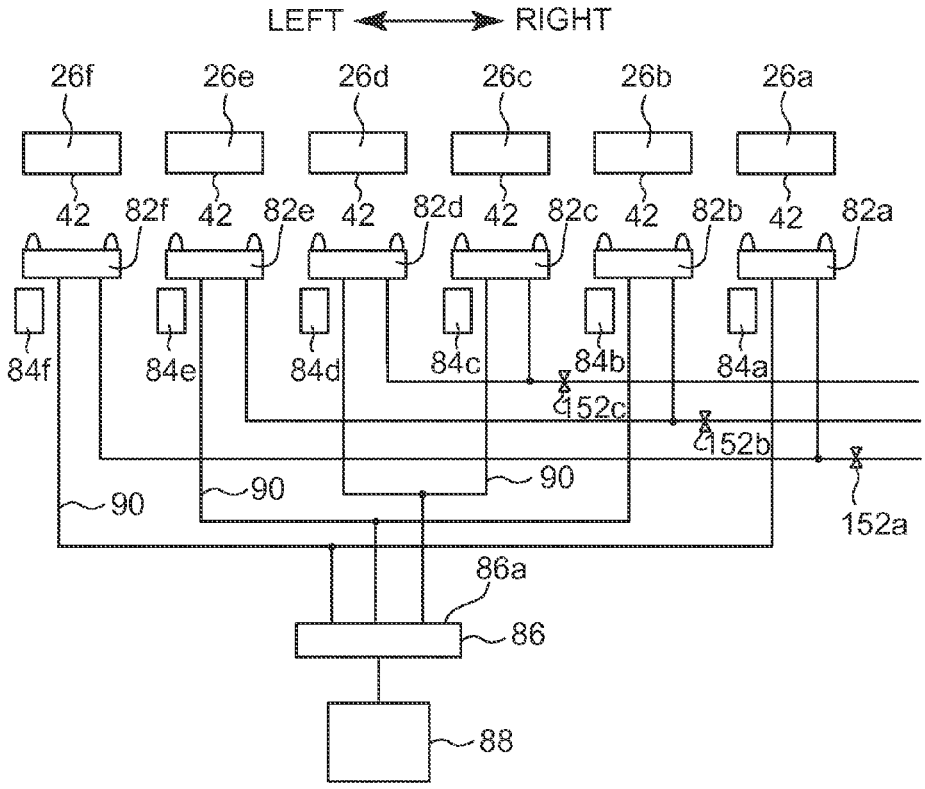
FIG. 12 depicts a configuration of another purge mechanism in yet another illustrative embodiment, according to one or more aspects of the disclosure.

In other embodiments, for example, as depicted in FIG. 12, in a purge mechanism 150, two or more of the caps 82*a*, 82*b*, 82*c*, 82*d*, 83*e*, and 82*f* corresponding to two or more head units, in which the ink discharging amounts are the same, of the head units 26*a*, 26*b*, 26*c*, 26*d*, 26*e*, and 26*f* may share the use of one of the ink tubes 90 and one of valves 152*a*, 152*b*, and 152*c* in the ink discharging process. In the embodiment depicted in FIG. 12, for example, the purge mechanism 150 may be applied to an inkjet printer adopting the "center alignment", and the ink discharging amounts may be the same in a pair of head units that may be spaced at the same distance from the center line of the ink ejection head 14 in the right-left direction. More specifically, each of a pair of caps 82*a* and 82*f*, a pair of caps 82*b* and 82*e*, and a pair of caps 82*c* and 82*d* may share the use of one of the ink tubes 90 and one of the valves 152*a*, 152*b*, and 152*c*.

In the above-described illustrative embodiment, as depicted in FIG. 4, the plurality of head units 26*a*, 26*b*, 26*c*, 26*d*, 26*e*, and 26*f* may be arranged individually. Nevertheless, in other embodiments, for example, a single laminated body comprising a plurality of metal plates may comprise the head units 26*a*, 26*b*, 26*c*, 26*d*, 26*e*, and 26*f* integrally therewith.

In the above-described illustrative embodiment, the control device 24 (see FIG. 3) may control the first wiper 98*a* to perform the wiping process to wipe the ejection surfaces 42 of the respective head units 26*a*, 26*c*, and 26*e* constituting the first head row 30*a* from the left to the right and also control the second wiper 100*a* to perform the wiping process to wipe the ejection surfaces 42 of the respective head units 26*b*, 26*d*, and 26*f* constituting the second head row 30*b* from the right to the left. Nevertheless, in other embodiments, for example, in a case of a sheet P2, in the ejection surfaces 42 of the respective head units 26*a* and 26*e* constituting the first head row 30*a*, the ejection surface 42 of the head unit 26*a* may be wiped from the left to the right and the ejection surface 42 of the head unit 26*e* may be wiped from the right to the left. Similar to this, in the ejection surfaces 42 of the respective head units 26*b* and 26*f* constituting the second head row 30*b*, the ejection surface 42 of the head unit 26*f* may be wiped from the right to the left and the ejection surface 42 of the head unit 26*b* may be wiped from the left to the right.

The processes disclosed in the above-described embodiments may be performed by the CPU of the control device 24 that may be a single CPU, a plurality of CPUs, a special application specific integrated circuit ("ASIC"), or a combination of a CPU and an ASIC.

In the above-described embodiments, as depicted in FIG. 1, the "liquid ejection device" may be applied to the inkjet printer. In other embodiments, the liquid ejection device may be applied to, for example, a facsimile machine or a copying machine, as well as a printer. Further, another liquid ejection method in which liquid may be ejected by pressure generated when a volume of liquid is expanded by a heat element may be adopted.

What is claimed is:

1. A liquid ejection device comprising:

a liquid ejection head comprising an ejection surface comprising a plurality of ejection nozzles configured to eject liquid to record an image;

a conveyor mechanism configured to convey a recording medium in a first direction;

a liquid discharging device configured to discharge the liquid from at least one of the plurality of ejection nozzles; and a control device configured to:

determine a dimension in a second direction of the recording medium conveyed by the conveyor mechanism, wherein the second direction is orthogonal to the first direction;

control the liquid discharging device to discharge the liquid according to a liquid discharging process after the liquid ejection head records an image onto the recording medium, the dimension in the second direction of which has been determined, wherein in the liquid discharging process, an amount of liquid discharged from each of one or more first ejection nozzles, which is one or more ejection nozzles, of the plurality of ejection nozzles, that correspond to an edge portion of the recording medium based on the dimension in the second direction, is greater than an amount of liquid discharged from each of one or more second ejection nozzles, which is one or more ejection nozzles, of the plurality of ejection nozzles, that correspond to an inward area of the recording medium, the inward area of the recording medium being an area of the recording medium that is between a first edge and a second edge of the recording medium in the second direction and excluding the edge portion of the recording medium.

2. The liquid ejection apparatus according to claim 1, wherein the liquid discharging process comprises a first maintenance process for discharging ink from the one or more first ejection nozzles and a second maintenance process for discharging ink from the one or more second ejection nozzles, and the control device is further configured to:

control the liquid discharging device to discharge the liquid according to one or both of the first maintenance process and the second maintenance process after the liquid ejection head records an image onto one recording medium and before the liquid ejection head records an image onto another of the recording medium subsequent to the one recording medium, and control the liquid discharging device to discharge the liquid according to the liquid discharging process such that a frequency of discharging the liquid according to the first maintenance process is greater than a frequency of discharging the liquid according to the second maintenance process.

3. The liquid ejection apparatus according to claim 1, wherein the liquid discharging device comprises at least one of: a suction device, a pressure application device, and a drive device, wherein the suction device is configured to suction ink from at least one of the plurality of ejection nozzles, the pressure application device is configured to discharge ink from at least one of the plurality of ejection nozzles by a pump, and the drive device is configured to drive the liquid ejection head to eject liquid from at least one of the plurality of ejection nozzles.

4. The liquid ejection apparatus according to claim 1, wherein the liquid ejection apparatus further comprises a capping device that is configured to seal at least one of the plurality of ejection nozzles, and the control device is further configured to:

determine one or more third ejection nozzles, which is one or more ejection nozzles, of the plurality of ejection nozzles, that correspond to an area outside of the recording medium and excluding the edge portion of the recording medium; and control the capping device to seal the one or more third ejection nozzles in a printing operation.

5. The liquid ejection apparatus according to claim 1, wherein the control device is further configured to control the liquid discharging device to discharge the liquid according to a liquid discharging process after the liquid ejection head records an image onto the recording medium, the dimension in the second direction of which has been determined, wherein in the liquid discharging process, an amount of liquid discharged from each of one or more third ejection nozzles is greater than the amount of liquid discharged from each of the one or more second ejection nozzles, and the amount of liquid discharged from each of the one or more third ejection nozzles is less than the amount of liquid discharged from each of the one or more first ejection nozzles, the one or more third ejection nozzles being one or more ejection nozzles, of the plurality of ejection nozzles, that correspond to an area outside of the recording medium and excluding the edge portion of the recording medium.

6. The liquid ejection apparatus according to claim 1, wherein the control device is further configured to control the liquid discharging device to discharge the liquid according to the liquid discharging process such that a period of time for discharging liquid from each of the one or more first ejection nozzles is greater than a period of time for discharging liquid from each of the one or more second ejection nozzles.

7. The liquid ejection apparatus according to claim 1, wherein the liquid ejection apparatus further comprises a capping device that is configured to seal at least one of the plurality of ejection nozzles, and the control device is further configured to:

control the capping device to seal the one or more first ejection nozzles in the liquid discharging process; and discharge an amount of liquid that substantially fills the capping device with liquid from the one or more first ejection nozzles.

8. The liquid ejection apparatus according to claim 1, wherein the liquid ejection apparatus further comprises a wiper mechanism configured to wipe the ejection surface, and the control device is further configured to control the wiper mechanism such that a first period of time is greater than a second period of time, the first period of time being a period of time between a completion of the liquid discharging process for the one or more first ejection nozzles and a completion of a wiping operation in which the wiper mechanism wipes a first area including the one or more first ejection nozzles, and the second period of time being a period of time between a completion of the liquid discharging process of liquid for the one or more second ejection nozzles and a completion of a wiping operation in which the wiper mechanism wipes a second area including the one or more second ejection nozzles.

9. The liquid ejection apparatus according to claim 1, wherein the liquid ejection apparatus further comprises a wiper mechanism configured to wipe the ejection surface, and the control device is further configured to control the wiper mechanism according to a first wiping operation and a second wiping operation sequentially, wherein the first wiping operation is configured to move the wiper mechanism with respect to an ejection surface including the one or more first ejection nozzles with a gap between a tip of the wiper mechanism and the ejection surface, and the second wiping operation is configured to move the wiper mechanism with respect to the ejection surface and in contact with the ejection surface.

10. The liquid ejection apparatus according to claim 1, wherein the liquid ejection apparatus further comprises a wiper mechanism configured to wipe the ejection surface, and the control device is further configured to control the wiper mechanism to wipe a first area including the one or more first ejection nozzles in the second direction and in a direction from the inward area of the recording medium to an area outside of the recording medium.

11. The liquid ejection apparatus according to claim 1, wherein the liquid ejection apparatus further comprises a wiper mechanism configured to wipe the ejection surface, and the control device is further configured to control the wiper mechanism to wipe a first area including the one or more first ejection nozzles in the first direction.

12. The liquid ejection apparatus according to claim 1, wherein the liquid ejection apparatus further comprises a reception portion configured to receive an information corresponding to the dimension in the second direction of the recording medium, and the control device is configured to determine the dimension in the second direction of the recording medium conveyed by the conveyor mechanism based on the information.

13. A non-transitory, computer-readable storage medium storing computer-readable instructions therein that, when executed by at least one processor of a liquid ejection device comprising a liquid ejection head comprising an ejection surface comprising a plurality of ejection nozzles configured to eject liquid to record an image, a conveyor mechanism configured to convey a recording medium in a first direction, and a liquid discharging device configured to discharge the liquid from at least one of the plurality of ejection nozzles, instruct the liquid ejection device to execute processes, comprising:

determining a dimension in a second direction of the recording medium conveyed by the conveyor mechanism, wherein the second direction is orthogonal to the first direction; and controlling the liquid discharging device to discharge the liquid according to a liquid discharging process after the liquid ejection head records an image onto the recording medium, the dimension in the second direction of which has been determined, wherein in the liquid discharging process, an amount of liquid discharged from each of one or more first ejection nozzles, which is one or more ejection nozzles, of the plurality of ejection nozzles, that correspond to an edge portion of the recording medium based on the dimension in the second direction, is greater than an amount of liquid discharged from each of one or more second ejection nozzles, which is one or more ejection nozzles, of the plurality of ejection nozzles, that correspond to an inward area of the recording medium, the inward area of the recording medium being an area of the recording medium that is between a first edge and a second edge of the recording medium in the second direction and excluding the edge portion of the recording medium.

14. A method of discharging liquid from a liquid ejection device comprising a liquid ejection head comprising an ejection surface comprising a plurality of ejection nozzles configured to eject liquid to record an image, a conveyor mechanism configured to convey a recording medium in a first direction, and a liquid discharging device configured to discharge the liquid from at least one of the plurality of ejection nozzles, the method comprising:

determining a dimension in a second direction of the recording medium conveyed by the conveyor mechanism, wherein the second direction is orthogonal to the first direction;

controlling the liquid discharging device to discharge the liquid according to a liquid discharging process after the liquid ejection head records an image onto the recording medium, the dimension in the second direction of which has been determined, wherein in the liquid discharging process, an amount of liquid discharged from each of one or more first ejection nozzles, which is one or more ejection nozzles, of the plurality of ejection nozzles, that correspond to an edge portion of the recording medium based on the dimension in the second direction, is greater than an amount of liquid discharged from each of one or more second ejection nozzles, which is one or more ejection nozzles, of the plurality of ejection nozzles, that correspond to an inward area of the recording medium, the inward area of the recording medium being an area of the recording medium that is between a first edge and a second edge of the recording medium in the second direction and excluding the edge portion of the recording medium.

* * * * *